US008371740B2

(12) United States Patent
Pestl et al.

(10) Patent No.: US 8,371,740 B2
(45) Date of Patent: Feb. 12, 2013

(54) CONTINUOUS FRAGRANCE AND ILLUMINATION DEVICE WITH REPLACEABLE FRAGRANCE REFILLS

(76) Inventors: Marcus Pestl, Dallas, TX (US); Sonia Hellen, Plano, TX (US)

( * ) Notice: Subject to any disclaimer, the term of this patent is extended or adjusted under 35 U.S.C. 154(b) by 194 days.

(21) Appl. No.: 12/958,547

(22) Filed: Dec. 2, 2010

(65) Prior Publication Data

US 2011/0134628 A1 Jun. 9, 2011

Related U.S. Application Data

(60) Provisional application No. 61/267,055, filed on Dec. 6, 2009.

(51) Int. Cl.
*H01R 33/00* (2006.01)

(52) U.S. Cl. ... 362/643; 362/101; 362/202; 362/249.16; 362/294; 362/810

(58) Field of Classification Search ..... 362/96, 362/101, 202, 205, 206, 643, 644, 249.02, 362/249.05, 249.16, 253, 294, 373, 390, 362/810

See application file for complete search history.

(56) References Cited

U.S. PATENT DOCUMENTS

| | | | | |
|---|---|---|---|---|
| 4,510,556 | A * | 4/1985 | Johnson | 362/184 |
| 4,816,973 | A * | 3/1989 | Atalla et al. | 362/643 |
| 6,106,786 | A * | 8/2000 | Akahoshi | 422/124 |
| 6,454,425 | B1 * | 9/2002 | Lin | 362/96 |
| 6,966,665 | B2 * | 11/2005 | Limburg et al. | 362/96 |
| 7,093,949 | B2 * | 8/2006 | Hart et al. | 362/96 |
| 7,204,870 | B2 * | 4/2007 | Zobele et al. | 96/222 |
| 7,670,035 | B2 * | 3/2010 | Tsai | 362/392 |
| 7,824,627 | B2 * | 11/2010 | Michaels et al. | 422/128 |
| 7,946,748 | B2 * | 5/2011 | Shen | 362/643 |
| 7,997,772 | B2 * | 8/2011 | Avtzon et al. | 362/392 |
| 2004/0257798 | A1 * | 12/2004 | Hart et al. | 362/96 |

* cited by examiner

*Primary Examiner* — Ismael Negron

(57) ABSTRACT

One embodiment of a continuous fragrance and illumination device having replaceable fragrance refill trays each comprising a curved back member that drop into vented fragrance refill chambers arranged around an air-moving member and surrounded by an illumination chamber formed by the external surfaces of a lens, an air-moving member housing, and the interior surface of a translucent shell that is closely adjacent to those surfaces and supported by a protective bottom cap, or separated by a greater distance. In addition, a translucent vanishing-edge lid is supported that provides a non-visible vent for exiting air following an air flow direction upward through the device. Other embodiments are described and shown.

5 Claims, 12 Drawing Sheets

CONTINUOUS FRAGRANCE AND ILLUMINATION DEVICE WITH REPLACEABLE FRAGRANCE REFILLS

CROSS-REFERENCE TO RELATED APPLICATIONS

This application claims the benefit of provisional patent application Ser. No. 61/267,055 filed 2009 Dec. 6 by the present first-named inventor.

BACKGROUND

Description of Prior Art

The commercial advantage of developing a real wax flameless candle with realistic illumination and a decorative appearance that can be filled and refilled with scented material for continuous fragrancing has long been recognized, but remains unaddressed in the marketplace because of the difficulty in realistically replicating all of the characteristics of fragranced wax candles. One of the most important commercial advantages of such a candle is that it would have an infinitely longer life than a fragranced wax candle because it would never burn down and so rather than buying expensive fragranced candles over and over again as they burn down, the consumer could instead shop for inexpensive fragrance refills and even change the fragrance of the candle. In this way, each such candle sold would produce an ongoing revenue stream rather than simply being a consumable product that is discarded once it has burned down.

For decades, the most popular fragranced, or scented, wax pillar candle has been produced in sizes ranging from about four to about six inches tall, and having a diameter of about three inches. In a traditional wax candle of this size with a wick the entirety of the candle's volume is occupied by wax in order to provide fuel for burning. A second function of the wax in this type of candle is to provide sufficient wax so that an outer wall of wax remains as the candle burns down, or tunnels. As the candle burns down, this wall largely preserves the original shape of the pillar candle and provides a translucent wall that enhances the effect of the flame within and illuminates the outer, upper portion of the candle which then blends in a visually pleasing manner with the darker, lower portion of the candle through which the flame's illumination does not penetrate. It is this aspect of a pleasing transition from the illuminated portion of the candle to the darker portion that is most desired by consumers when selecting flameless candles because when effected properly it becomes virtually impossible to distinguish a flameless candle from a real candle. A further benefit of the tunneling that occurs in a properly constructed wax pillar candle is that light from the flame is reflected from the inside of the wall so when viewing the lit candle from above the center appears as a brighter pool of light that blends seamlessly with the inside of the outer wax wall. To be considered as a realistic alternative to a real candle, flameless candles must therefore meet these visual criteria of pleasing top and exterior illumination. There are several flameless candles currently available that meet these illumination criteria, but they are limited by their ability to match the fragrancing characteristics of real scented candles.

A third, essential function of the wax in a fragranced candle is to stabilize in combustible form the fragranced oil that is mixed therein and provides the scent given off by the candle. The fragrance given off by a scented pillar candle is described in two ways, as cold throw and hot throw. The cold throw refers to the fragrance given off only by the fragranced wax body of the candle. This fragrance is noticeable only when one is in close proximity to the candle, or if it is held close to one's nose. The hot throw of a scented candle refers to the fragrance that is burned off, or volatized, by the burning wick. When volatized in such a manner, the fragrance contained in a scented candle will normally fill a room, so one does not need to be close to the candle to notice its fragrance. In many cases the cold throw fragrance of a candle has different characteristics to the hot throw fragrance. This discrepancy can lead to consumer dissatisfaction with candle products as only very upscale retailers provide a way for the consumer to sample the hot throw of a candle prior to purchase. A further disadvantage of fragranced candle products is that often the fragranced oil leaches out of the wax and evaporates over time meaning that scented candles are perishable. To be considered as a realistic alternative to a real candle, flameless candles must meet both the hot and cold throw fragrance characteristics of real scented candles. There are several flameless candles available that use scented wax in their manufacture and thus provide the same cold throw as a real scented candle with the same disadvantage that the fragranced oil evaporates over time, after which the candle no longer has any cold throw. However, there are currently no flameless wax candles on the market that can provide a fragrance experience equivalent to the hot throw of a real scented candle and which also meet the illumination criteria of a real candle. It can be said there are no commercially available flameless wax candles that are able to fragrance continuously.

In addition to the many aesthetic and functional challenges that must be overcome to create a flameless candle with the necessary perceived value to be considered as a replacement for a real candle, such a product must also address how consumers today want to experience fragrance. An emerging trend in fragrance is noted where consumers like to self-select and create their own blends, or layers, of different fragrances, and also like to use the same fragrances they use at home in other environments they inhabit such as their car or workplace. To facilitate this trend it should be easy for consumers to select, mix and use any number of fragrance refills in this manner. Products must also feature multiple chambers so the consumer has a choice of inserting one or more fragrance refills. Further consideration should also be given to the need to disable the fragrance emission of such products, for example when used to provide decorative illumination around food where one does not want any fragrance to compete with the food aromas. Accordingly, examination of the prior art shows little scope for flameless pillar candle products in this field that meet the dual criteria of providing pleasing illumination for its own sake without fragrance, and providing the consumer with the benefit of being able to easily use their own selection of one or more fragrance refills to meet their fragrance needs.

A flameless candle with an air intake and an air outflow chamber is described in Limberg et al. U.S. Pat. No. 6,966,665. An embodiment of a wax candle is described divided into chambers with an air-moving device that blows an air stream past a wick into which is drawn a liquid fragrance and thus the volatized fragrance is blown into the room. In this way the device is intended to replicate the hot throw of a scented wax candle. Apart from the obvious disadvantage that if this candle were to be knocked over the liquid fragrance oils contained in the refill would shortly thereafter drip onto and damage household surfaces such as varnished wood or plastics, it is not apparent that this device would provide a pleasing illumination in respect of a real flame candle. This is because the interior components of the candle are directly exposed to the light emitted by the light emitting material and would thus cause shadows of the components to be cast onto the inside surface of the outer shell. As the outer shell is described in one embodiment as wax, which by its very nature is translucent, these shadows would be visible on the exterior surface of the candle and it would therefore not provide a pleasing transition of light to dark and thus would not in any way mimic the illumination of a real candle that has tunneled down. A further disadvantage of this art is that a lid is claimed with defined vents to allow air to circulate in and out of the air chambers. These vents will be immediately apparent to anyone viewing the candle from above and will obviously detract from the expected appearance of a real flame candle where the center presents a brighter pool of light that merges seamlessly with the outer wax wall. Yet another disadvantage of the art is that the fragrance refill must be replaced from the bottom and the wax shell is supported by a base structure. This means the shell must be lifted on and off this base structure in order to replace the fragrance refill and thus the wax shell becomes subject to damage from frequent handling. With regard to the base structure this detracts from the candle appearance that the device is attempting to imitate because a traditional wax candle does not have a separate base structure. Yet another limitation with respect to today's consumer desire for smaller, more convenient fragrance portions that can be assorted is apparent from the size of the refill bottle in that only one refill bottle can be inserted into the candle at any one time.

Various embodiments of an active material emitting device resembling a flameless candle are described in Jaworski et al. U.S. Pat. No. 7,350,720 and Porchia et al. U.S. Pat. No. 7,503,668. A limitation of the device with regard to how closely its top appearance mimics a real candle is apparent from the several vents that surround the light emitting diode and puncture the top surface. Because the top surface is broken up with these vents and therefore cannot provide a seamless pool of light to blend with the exterior shell, this device could not pass for an imitation fragranced pillar candle when being viewed from the top and would therefore not have the perceived value of a real candle. A further limitation of the device is apparent from the means by which the fragrance inserts are replaced. If there is an outer shell it must be removed, or the fragrance emitting unit of the device containing the light emitting diode must be removed from the outer shell prior to it being taken apart to access the fragrance refills. Whether the fragrance refills are inserted from the top or the bottom, this construction presents consumers with a complicated array of steps that must be followed simply to replace spent fragrance cartridges. When faced with such complexity, many might simply opt to light a fragranced candle. While the later art of U.S. Pat. No. 7,503,668 does show a broad array of refill options consistent with the need to provide selectable fragrance options, many of these are joined together and require the user to fold and anchor them into the unit, thus further limiting their ease of use.

Reckitt Benckiser's Airwick electric candle comprises a translucent plastic outer shell, flickering amber light emitting diodes and a replaceable fragrance bottle. This embodiment does not present as smooth a transition of exterior illumination as would be possible if the outer shell were wax. However, if the open outer shell were wax it would crack from repeated handling while inserting replacement fragrance bottles into the bottom of the device because the open top is not supported by a lid or rim of other material. In addition, the open top of the device does not in any way resemble a burning candle with its pool of light, and only one large liquid fragrance bottle can be inserted into the unit instead of several convenient fragrance portions that will cannot drip and damage surfaces if the piece is knocked over. Another device with a plastic outer shell resembling a flameless candle with an air-moving member to distribute fragrance is described in Bistritzky et al. U.S. Pat. No. 7,481,571. I have found that the exterior of the device when illuminated shows shadows cast by the interior components because no attempts are made in the construction to shield the inner components from the light emitting material. These shadows would be softer if the exterior were wax, but would still exist. Some attempt is made in this device to minimize the appearance of the vents in the top surface, but it is difficult to see how these vents could be manufactured into a wax shell because of their small size. This device is further limited because only a single fragrance cartridge can be inserted into the unit.

An imitation flame candle with continuous fragrance is described in Hart et al. U.S. Pat. No. 7,093,949. This device is intended to prominently display an imitation flame of fluttering material. This aspect of displaying an imitation flame is not highly valued among consumers of flameless candles who prefer that the appearance of a glowing candle is mimicked wherein the flame has tunneled down into the body of the candle and is therefore no longer visible.

Convenient fragrance portions are described in U.S. Pat. No. 7,182,270 to Buthier; U.S. Pat. No. 7,036,747 to Charmer; and U.S. Pat. No. 7,530,503 to Caserta et al. However, these portions are not designed for, nor are they suited for, use in a decorative flameless candle or illumination device that is capable of fragrancing continuously. Rather, these are described in terms of their improved functionality and attractiveness as standalone fragrance portions that can be hung, adhered or positioned anywhere.

Other convenient fragrance portions and dispensers with decorative possibilities or functional enhancements are described in Gordon et al. U.S. Pat. No. 5,439,100; Skalitzky et al. U.S. Pat. No. 6,722,578; and Martens et al. U.S. Pat. No. 7,213,770. Any of these fragrance portions or dispensers could be positioned together by a user to create blends of fragrances. However, none of these is disclosed in the prior art as intended for use in an illumination device, or in a flameless candle, with continuous fragrance capability, thus limiting their application in this field of invention.

A device for emitting a combination of fragrances either individually or together for varying time periods is described in Kvietok et al. U.S. Pat. No. 7,223,361. However, the device is not disclosed as having illumination or decorative properties, and it is intended as a plug-in device for continuous fragrance. No attempt is made in the art to disclose the device as a flameless candle or as a realistic replacement for a scented wax candle. U.S. Pat. No. 5,651,942 to Christensen discloses a cylindrical structure containing a heat-producing light source positioned below a pan designed to hold any combination of readily available household materials such as dried herbs, flowers and the like. While this disclosure captures the spirit of combining fragrance, most consumers do not want to deal with the measuring and handling of loose fragrance ingredients in the manner required of this disclosure and prefer to purchase pre-sized fragrance portions they can use in a continuous fragrance device, or place and hang anywhere.

A multitude of other devices that contain and emit combinations of fragrance, either by ambient or active means, are described in Arnell et al. U.S. Pat. No. 6,713,024; U.S. Pat. No. 6,602,475 to Chiao; Bartsch et al. U.S. Pat. No. 6,581,915; U.S. Pat. No. 5,565,148 to Pendergrass; Sullivan et al. U.S. Pat. Nos. 5,342,584 and 5,234,162; and Roth et al. U.S. Pat. No. 3,575,346. While all of the devices disclosed in these patents are capable of emitting combinations of fragrance, none of these devices discloses any illumination, nor does any of this prior art disclose any embodiment that represents a wax flameless candle with the perceived value of a real wax scented candle.

SUMMARY

In accordance with one embodiment a continuous fragrance and illumination device comprising an outer shell and inner wall forming an illumination chamber, a vanishing edge lid, a protective bottom edge, and a plurality of inner chambers to receive portioned fragrance refills surrounding an air-moving member.

Advantages

Accordingly several advantages of one or more aspects are as follows: to provide a pleasing fall-off of illumination originating from the upper portion of the exterior vertical surface and a brighter pool of light at the top horizontal surface, a removable lid that provides venting but shows no apparent vents and appears visually seamless with the exterior wall, the capability to fragrance continuously, protective enhancements to ensure the long life of the device, and the ability to insert any combination of one or more fragrance refills or to provide illumination without fragrance. Other advantages of one or more aspects will be apparent from a consideration of the drawings and ensuing description.

DRAWING FIGURES

In the drawings, closely related figures have the same number but different alphabetical suffixes.

DRAWINGS

Reference Numerals

| | |
|---|---|
| 10 | flat translucent shell |
| 14 | translucent wick top lid |
| 18 | circuit control board |
| 20 | fragrance refill tray |
| 24 | fan-moving member |
| 28 | illumination chamber |
| 32 | air-moving member |
| 36 | electrical wiring |
| 40 | electrical wiring conduit |
| 44 | fragrance refill chamber |
| 48 | air-moving member housing |
| 52 | battery cell contacts |
| 56 | battery cell housing |
| 60 | battery housing door |
| 64 | control switch |
| 68 | battery housing door clip |
| 72 | feet |
| 76 | air intake flue |
| 80 | air discharge vents |
| 84 | light emitting diodes |
| 88 | lens |
| 92 | air flow direction |
| 96 | translucent flame top lid |
| 100 | translucent flame top member |
| 104 | support pin |
| 108 | tall translucent shell |
| 112 | spacing member |
| 116 | short translucent shell |
| 120 | AA size battery cell |
| 124 | short air intake flue |
| 128 | handle |
| 132 | curved back member |
| 136 | fragranced gel |
| 140 | retainer |
| 144 | wavy translucent shell |
| 148 | vessel |
| 152 | sealing ring |
| 156 | protrusion |
| 200 | timer |
| 204 | bottom cap |
| 206 | lip |

DETAILED DESCRIPTION

FIGS. 1A, 1B, 1C, 1D, 3A and 6A—First Embodiment

Figure 1A:
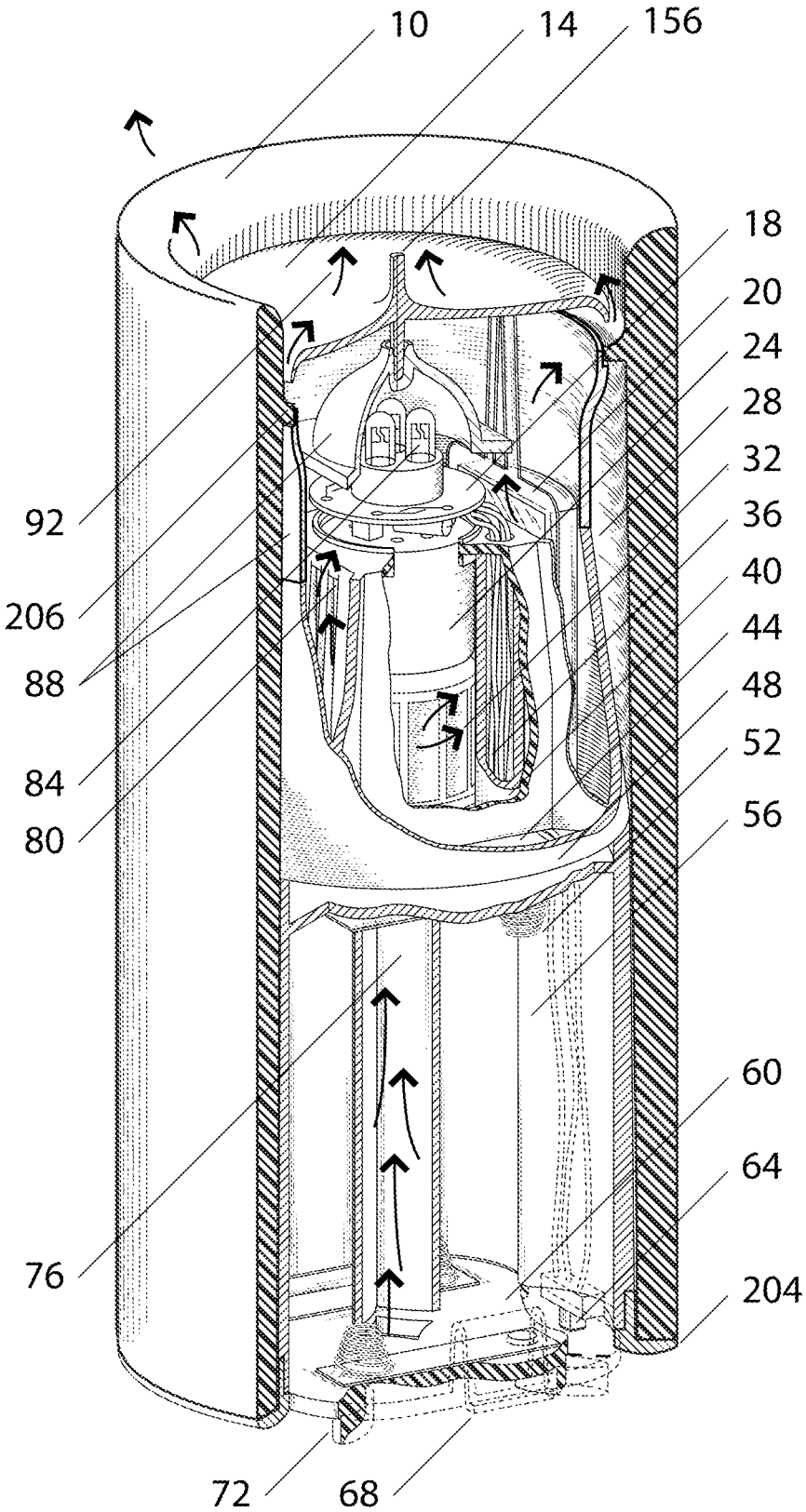
FIG. 1A shows a cut-away perspective view of a continuous fragrance and illumination device with a wick top lid in accordance with one embodiment.

One embodiment of the continuous fragrance and illumination device is illustrated in FIG. 1A (cut-away perspective view). The continuous fragrance and illumination device has a hollow cylindrical outer translucent shell 10 that is open at both ends. In one embodiment, shell 10 is approximately 80 mm in diameter and approximately 160 mm tall. A level upper edge forming an outer diameter of shell 10 curves smoothly downward to form an inner diameter such that the thickness is approximately 7 mm at its top. At its lower flat edge the thickness of shell 10 is approximately 5 mm and thus the inside wall tapers toward the top edge. Approximately 15 mm from the top edge of shell 10 a lip 206 protrudes perpendicularly from its inside surface for a distance of approximately 3 mm and circumscribes the entire inside diameter. The top surface of lip 206 curves upward toward the inner wall of shell 10 to create a smooth join such that no seam is visible.

In one embodiment shown in FIG. 1A, the shell 10 is made by pouring translucent paraffin wax into a mold. This technique allows a variety of colors, surface finishes, embossments and other decorative effects to be produced throughout the shell, as well as on its visible exterior surface by those skilled in the art. These can include embedding materials into the shell such as dried flowers and other items. However the shell can consist of any other translucent material that can be shaped or molded and can transmit illumination. Such materials include, but are not limited to, plastics, resins, ceramics, porcelain, and glass. Such materials may also be finished by those skilled in the art in ways that enhance the visual appeal of the shell.

In one embodiment shown in FIG. 1A, the open top of shell 10 is occupied by a lid 14 that is of a slightly smaller diameter than the inner diameter of the shell, but of a larger diameter than the inside diameter of lip 206. In this embodiment a protrusion 156 is provided on the upper surface of the lid that resembles the wick of a real candle, and also provides a means for grasping and removing the lid from the opening in the shell. The vertical wall of the protrusion curves gently to meet the generally horizontal surface of the lid in the manner in which the wick of a real candle draws a curved build-up of wax around its base. In one embodiment shown in FIG. 1B, when the lid is inserted in the opening of shell 10, its outer edge terminates at a point that is beyond the sight line of any viewer looking at the device from a normal viewing angle. In this way, the top outer surface of the lid provides a vanishing edge that blends with the inner wall of the shell 10 in much the same way that seaside swimming pools can be designed with a vanishing edge to make it appear as though the pool water is blending seamlessly with the ocean beyond. However, in other embodiments the lid 14 of FIG. 1B may be contoured so that it is flat, or it may be contoured so its outer edge turns up instead of down, or the lid may be contoured with an outer edge that variously turns up and down at different points along its perimeter. In yet other embodiments, the lid may be provided with an irregular, rough appearance to its upper surface in order to better mimic the irregular appearance and melting of a burning candle.

In one embodiment shown in FIG. 1A, the lid 14 is injection molded from a translucent material that has the same color and light refraction properties of the shell 10. However the lid is substantially less thick than the shell. While it is desirable that the shell and the lid are made from the same material, it is known to those skilled in the art that plastics and resins can be made to match the visual surface and refractive properties of wax. Thus the lid and shell do not need to be manufactured from the same material in order to exhibit the same visual surface and refractive properties as each other. However, the lid can be manufactured from a variety of materials. Such materials include, but are not limited to, plastics, resins, ceramics, porcelain, and glass. Such materials may also be finished by those skilled in the art in ways that enhance the visual appeal of the shell.

In one embodiment shown in FIG. 1A, the protrusion 156 continues on the underside of the lid 14 and forms a pin that can be used to secure the lid in a lens 88 that is located centrally within the shell 10 and supported at its lower edge by an air-moving member housing 48. In one embodiment the lens 88 is a single molded part comprising a smaller dome structure at its center connected to a square flange, which in turn is connected by four supports at its corners to an outer vertical wall structure. The protrusion 156 fits into a well located at the top of the lens dome. In one embodiment the outer wall structure of the lens comprises an upper edge that mates substantially with the inner diameter of the lip 206 that is part of the shell 10. In mating thus with the lip the lens provides substantial reinforcing to the shell that, in its wax form, would have little resistance to normal wear and tear. The bottom outer edge of the lens 88 is of a smaller diameter than the inside diameter of the shell 10. In one embodiment the lens is made from a transparent plastic material and its surface is frosted or roughened to produce maximum diffusion of light passing through it. However, the lens can be manufactured from a variety of transparent or translucent materials. Such materials include, but are not limited to, plastics, resins, ceramics, porcelain, and glass.

Figure 6A:
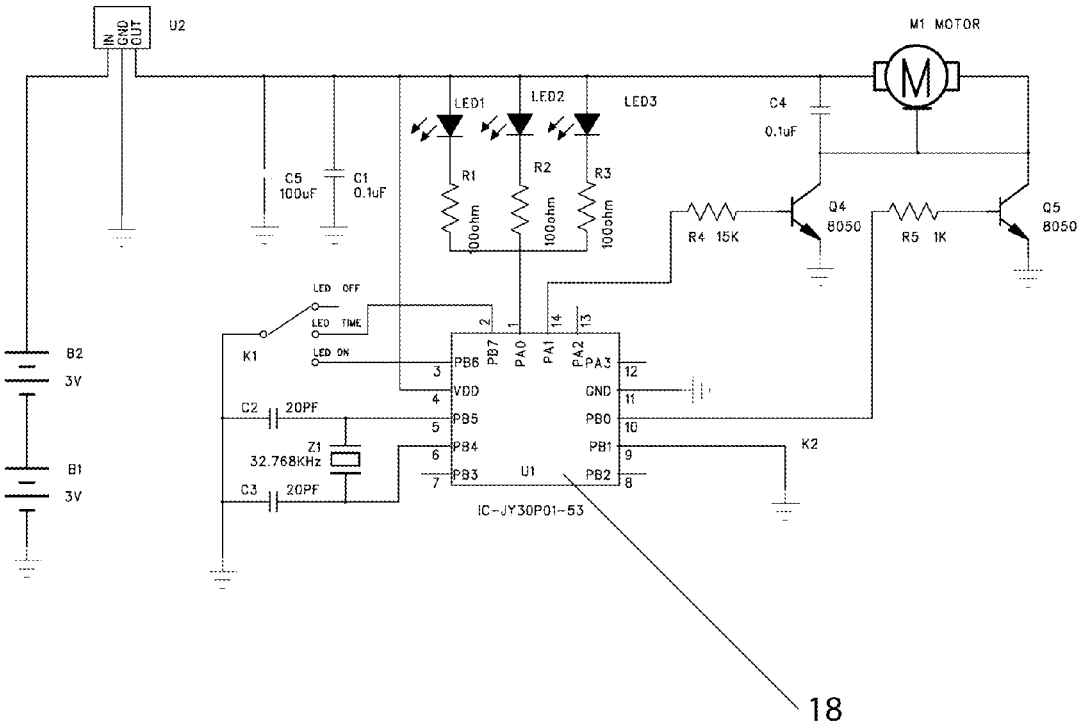
FIG. 6A shows a wiring diagram with a three-position switch for user control of illumination.

FIG. 6A shows a wiring diagram representing an arrangement of electrical components and power sources connected to each other through a circuit control board 18. In one embodiment shown in FIG. 1A, three light emitting diodes 84 are located directly beneath the lens 88 dome and mounted to the top surface of a circuit control board 18. In this embodiment the light emitting material comprises light emitting diodes, however any suitable light emitting material or device may be used. Connected to the underside of the circuit control board is a fan-moving member 24, which in one embodiment is a small DC electric motor of approximately 24 mm diameter. In this embodiment a circular opening in the top surface of the air-moving member housing 48 is sized to exactly fit the fan-moving member 24 and secure it during operation. Attached to the spindle of the motor is an air-moving member 32 that in this embodiment is a squirrel-cage type fan constructed such that when it rotates in the same direction as its blades are angled, air is pushed away from the fan blades in a direction perpendicular to the center of their rotation. The circuit control board comprises various electrical components known by those skilled in the art to vary the strength and time period of an electrical current supplied to the light emitting diodes and the fan-moving member. In this way a variable current supplied to the light emitting diodes causes them to flicker, imitating the flickering flame of a real candle.

Figure 1B:
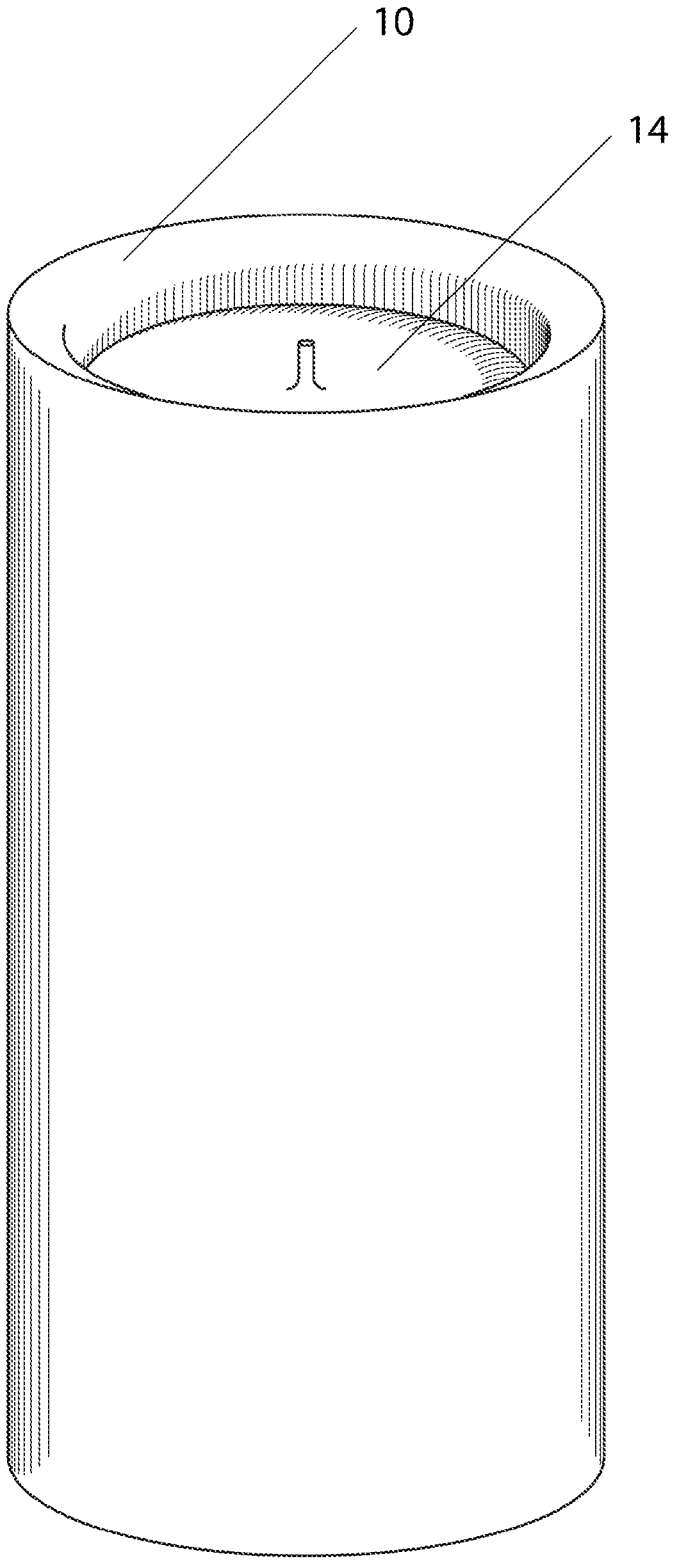
FIG. 1B shows a perspective view of a flat top continuous fragrance and illumination device with a wick top lid in accordance with one embodiment.
Figure 1C:
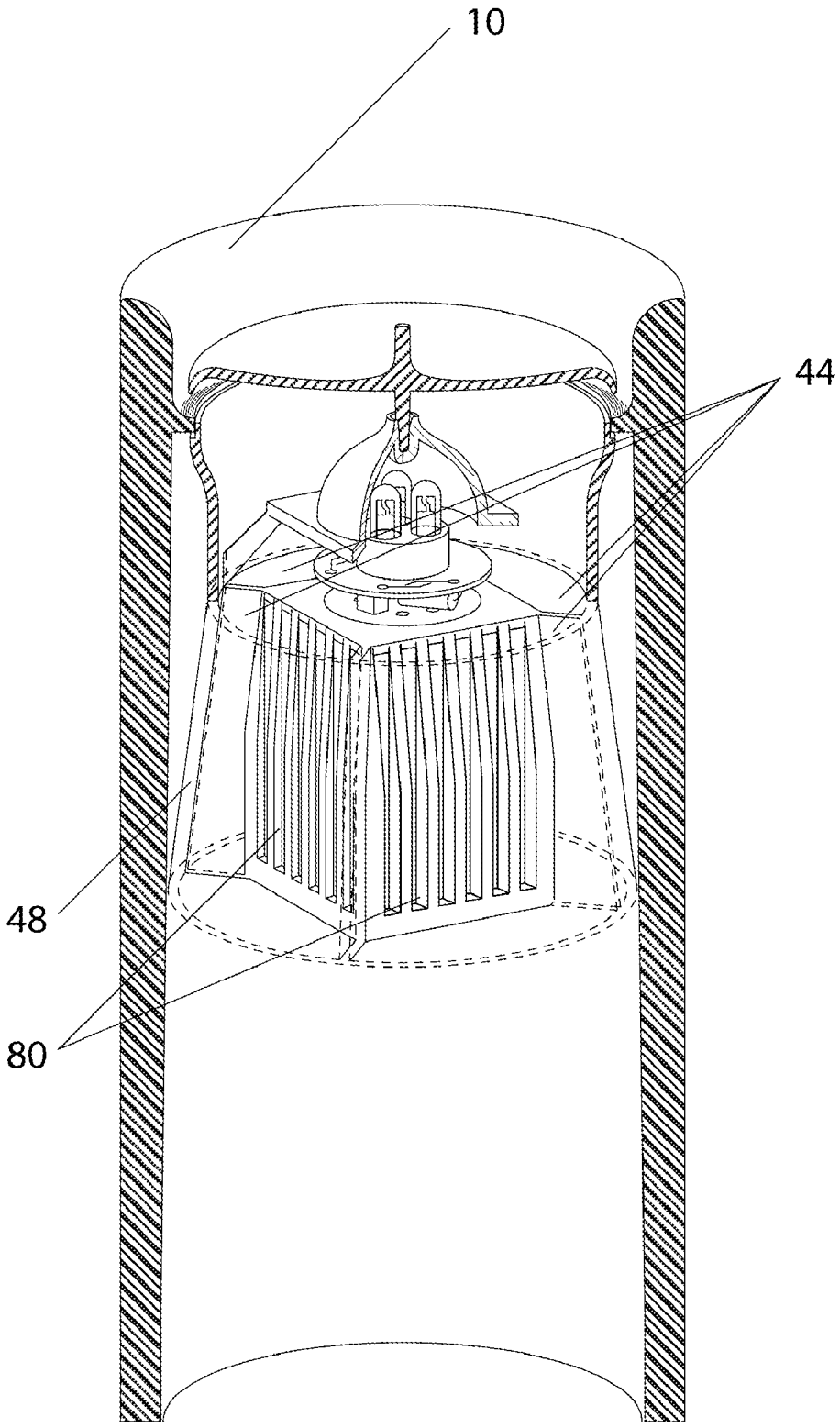
FIG. 1C shows a perspective cut-away view of a flat top continuous fragrance and illumination device with a wick top lid and four vented fragrance refill chambers in accordance one embodiment.

In one embodiment shown in FIG. 1C, the configuration of the air-moving member housing 48 is a centrally located four-sided enclosure that is vented with vertical air discharge vents 80 on all four sides. Each of these four sides has an upper portion that is inclined from the vertical and each side forms one side of a fragrance refill chamber 44. An opposite side of the fragrance refill chamber is formed by a conical outer wall of the air-moving member housing 48. Each fragrance refill chamber is divided from the next by a vertical fin that connects the four-sided enclosure and the conical outer wall of the air-moving member housing. In this embodiment each refill chamber is sized to accept a fragrance refill tray 20 that can be placed into the chamber by removing the lid 14. In one embodiment the volatile fragrance oil compounds contained within the fragrance refill tray are released by air that blows over the surface of a solid gel containing fragrance oil, but the fragrance may be volatized but other means, such as heat, in which case the space allocated to the air-moving member would be occupied by the volatization means known by those skilled in the art as needed to volatize other forms of fragrance encapsulated in portions that can be lifted in and out of the fragrance refill chambers.

In one embodiment shown in FIG. 1A, the lower outer edge of the air-moving member housing 48 is sized at substantially the same diameter as the inside of the shell. In this embodiment the area between the air-moving member housing 48, the lens 88, and the inner wall of the shell 10, an illumination chamber 28 is formed consisting of an air pocket that circumscribes the interior of the shell. Light emitted from the light emitting diodes bounces around inside this illumination chamber and is thus diffused before being transmitted through the translucent shell. As the illumination chamber narrows towards its lowest point, less illumination reaches the outer surface of the wax shell at that point. Accordingly, in this embodiment, the outer vertical wall of the shell glows more brightly at the top, and with ever-decreasing brightness approaching the point at which the lower edge of the air-moving member housing meets the interior wall of the shell. In this embodiment the air-moving member housing is made from an opaque plastic material preferably in a white or off-white color to maximize the quantity of light transmitted to the outside wall of the shell. However, to vary the illumination effects, the air-moving member housing can be manufactured from a variety of opaque, transparent or translucent materials. Such materials include, but are not limited to, plastics, resins, ceramics, porcelain, and glass.

In one embodiment shown in FIG. 1A, a battery housing member 56 supports the air-moving member housing and comprises an inner wall shaped to accommodate four 1.5 volt C size batteries in a vertical configuration, and a centrally-located air intake flue 76 that is open at both ends and has a uniform width. A battery door 60 seals the battery housing member and provides tension so that when batteries are inserted spring metal contacts 52 create a flow of electric current in electrical wiring 36 connected to the circuit control board. In this embodiment two pairs of batteries are connected in series, and these pairs of batteries are connected in parallel to deliver a maximum of three volts into the circuit. A clip 68 is molded into one end of the battery housing door that can lock into a ridged well in a bottom cap 204 and acts to secure the battery door in the bottom cap. FIG. 1A shows an outer edge of a bottom cap that comprises a horizontal flange upon which the translucent shell of this embodiment is secured by means of an adhesive that bonds to wax, and to other materials that have been named as suitable for construction of the translucent shell. On the opposite side of the battery door protrusions are provided to engage with the bottom cap. A vent hole is provided in the center of the battery door that is sized substantially the same as the open end of the air intake flue 76. In this embodiment raised feet 72 approximately 5 mm tall are molded into the underside of the battery door housing but are not visible when the candle is viewed from a normal viewing angle. In this embodiment the battery housing member, the battery housing door, and the bottom cap are made from an opaque plastic material with a high tensile strength and preferably in a white or off-white color. However, these parts can be manufactured from a variety of materials. Such materials include, but are not limited to, various other plastics and resins.

In one embodiment shown in FIG. 1A, a control switch 64 is wired into the electrical circuit to control the operation of the light emitting diodes and is located on the underside of the battery cell housing. In this embodiment the switch has three positions—off, on, and timer. In the off position the light emitting diodes will not operate at all, or will operate continuously when the control switch is in the on position. In the timer position the operation of the light emitting diodes will be controlled by an electronic timer located on the circuit control board. In this embodiment the timed period of operation is six hours on followed by 18 hours off, but as is known to those skilled in the art the timer control can be varied according to the needs of consumers, and even be provided as a variable timer control that can be set by the user. In one embodiment the air-moving member is wired directly into the circuit control board and has no user control. However, user control of the air-moving member can be provided by wiring a separate switch to the underside of the battery cell housing in the same manner as control switch 64. Timer control of the air-moving member may be facilitated by those skilled in the art by means of a timer located on the circuit control board that switches the fan on and off according to an electronic switch controlled by a pre-programmed time interval. User control features and timing intervals of light emitting diodes and the air-moving member are not limited to those described here, but can be determined according to any possible combination that is known by those ordinarily skilled in the art.

Figure 3A:
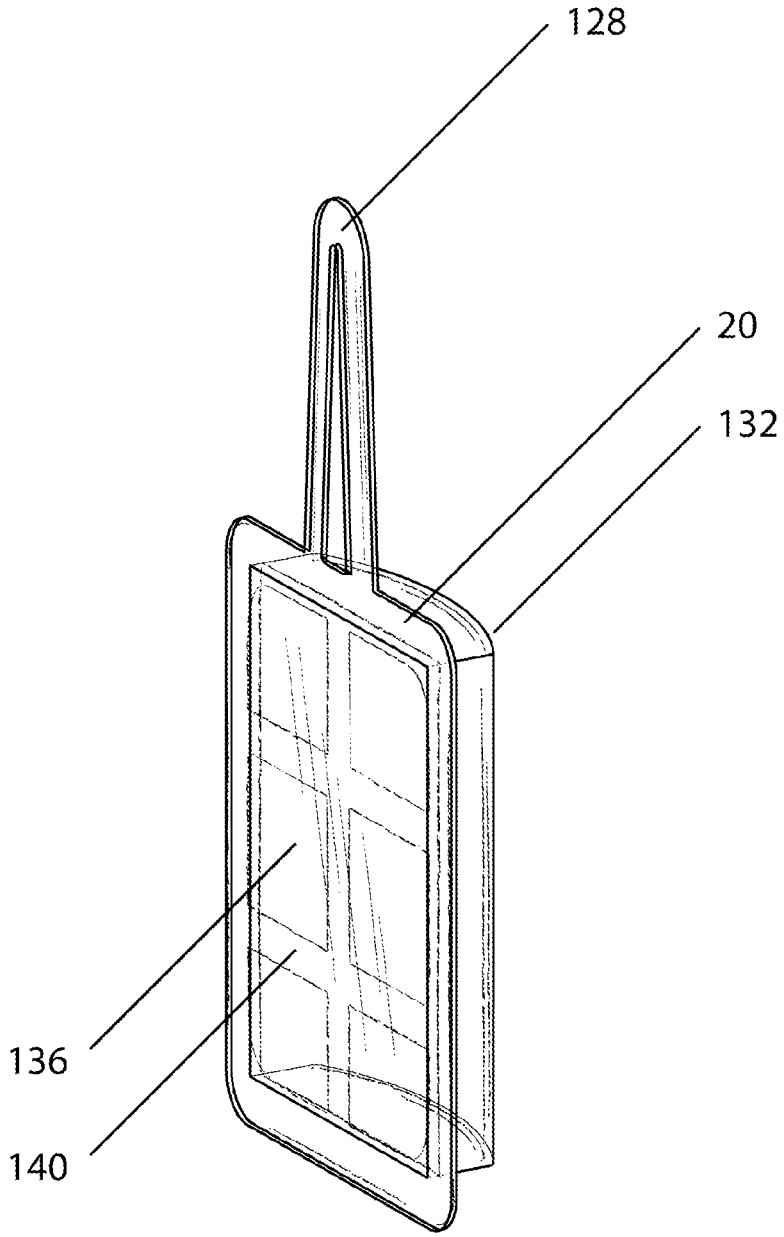
FIG. 3A shows a perspective view of a fragrance refill tray with a curved back structure and a handle in accordance with one embodiment.

In one embodiment FIG. 3A shows a fragrance refill tray 20 comprising a clear semi-rigid four-sided flanged well with a curved back member 132 and a handle 128 attached to the flange. The handle may be perforated with a hole approximately 2 mm in diameter located near the end farthest from the well and through which a string forming a loop approximately 130 mm in length may be tied for hanging the refill from the rear view mirror of a car, or any other such hanging application. The well of the fragrance refill tray can be filled with a fragranced gel 136 comprising a solidifying gel mixed with a majority percentage of fragrance oil. Such fragrance oils may replicate fragrances such as apple, vanilla, lavender and various other fragrance oils available commercially and known to those skilled in the art as capable of being mixed with a solidifying gel. In one embodiment, other substances such as odor-neutralizing compounds may be added to the gel in addition to fragrance oil to enhance the functionality of the fragrance refill. It is known to those skilled in the art that such compounds can be added without affecting the performance of the fragrance oil. A retainer 140 resembling a grid and made of a thin flexible clear film is adhered to the top surface of the flanged well to prevent the solidified gel from falling out of the well as the fragrance oil evaporates and the gel shrinks away from the sides of the well. In one embodiment the fragrance refill tray is made from recycled polyethylene terathalate that is 0.3 mm thick, but the fragrance refill tray can be made from other thin, clear semi-rigid materials that are resistant to the effects of volatile substances contained within the fragrance oil mixed into the solidifying gel. In one embodiment the fragrance refill tray is filled with a gel, but the fragrance refill tray can consist of any fragrance portion containing volatile fragrance or odor-neutralizing compounds that can be activated by heat or other means. In another embodiment shown in FIG. 1D, a fragrance refill tray 20 is shown partially inserted into a continuous fragrance and illumination device.

Operation—FIGS. 1A-1D

Figure 1D:
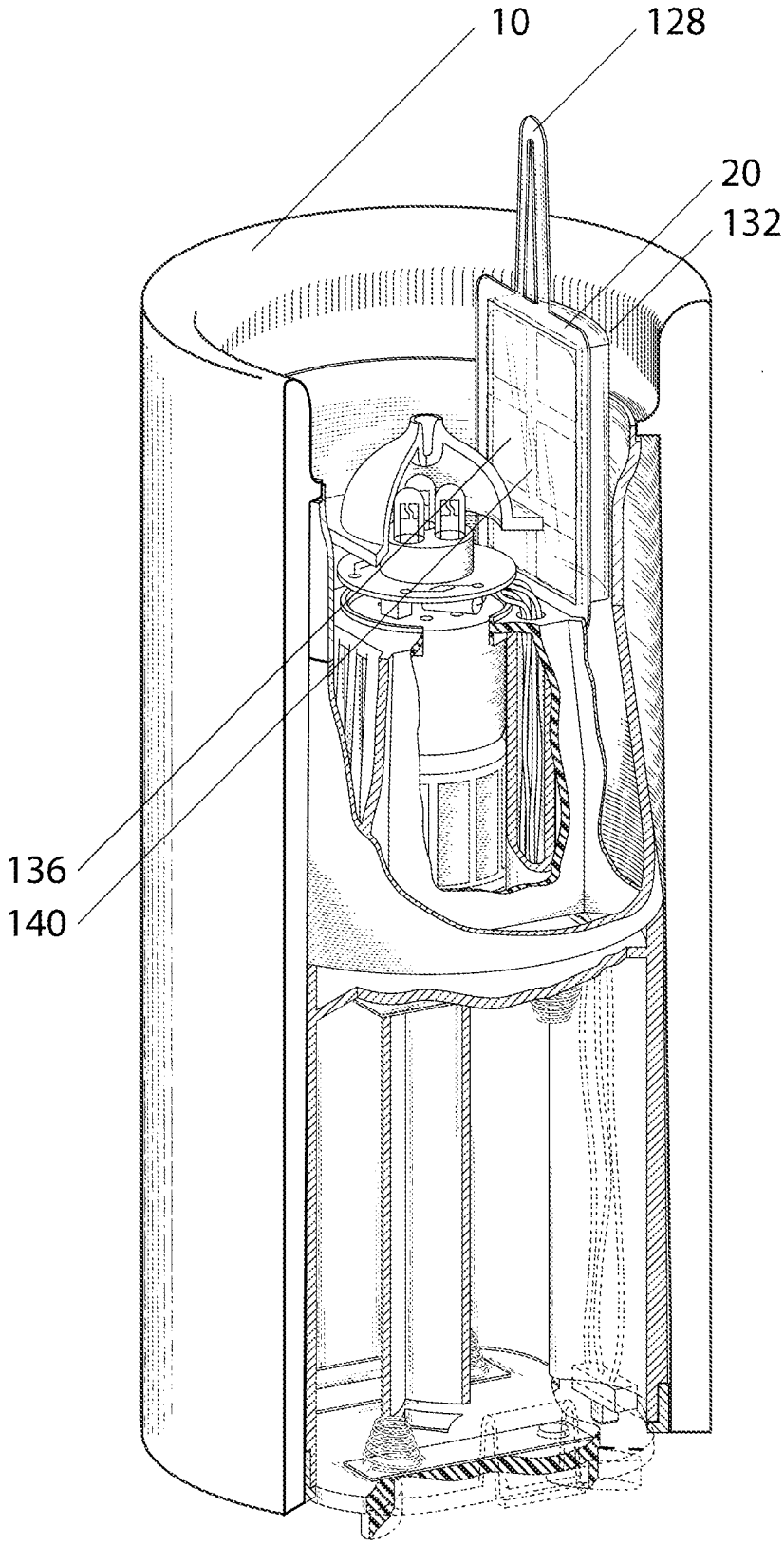
FIG. 1D shows a perspective cut-away view of a flat top continuous fragrance and illumination device with a fragrance refill tray partially inserted into a fragrance chamber in accordance with one embodiment.

The manner of using the continuous fragrance and illumination device is to open the battery door by pressing in battery housing door clip 68 and inserting four batteries with correct polarity arrangement, then replacing the battery door by engaging the battery housing door clip with the ridged well of the bottom cap. The horizontal flange of the bottom cap covers and protects the lower edge of the translucent shell 10 from any damage that may be sustained during normal use if the translucent shell is made from wax. Control switch 64 can be set to off, on, or timer mode to control illumination of the light emitting diodes 84. When the translucent wick top lid 14 is removed, up to four fragrance refill trays 20 can be inserted vertically into the continuous fragrance and illumination device by dropping them into the fragrance refill chamber 44 (FIG. 1D). When the fragrance refill trays are inserted in this manner, the air-moving member draws air up the air intake flue and blows it over the top surfaces of the fragrance refill trays. As the moving air passes over the top surface of the fragranced gel 136, volatized fragrance compounds are carried in the air that emerges from the top of the continuous fragrance and illumination device in the air flow direction 92 indicated. In this manner the continuous fragrance and illumination device will emit fragrance from its top surface and will fragrance a room according to the fragrance contained in the solidified gel, as well as supplying additional environmental benefits such as odor-neutralization.

Figure 1E:
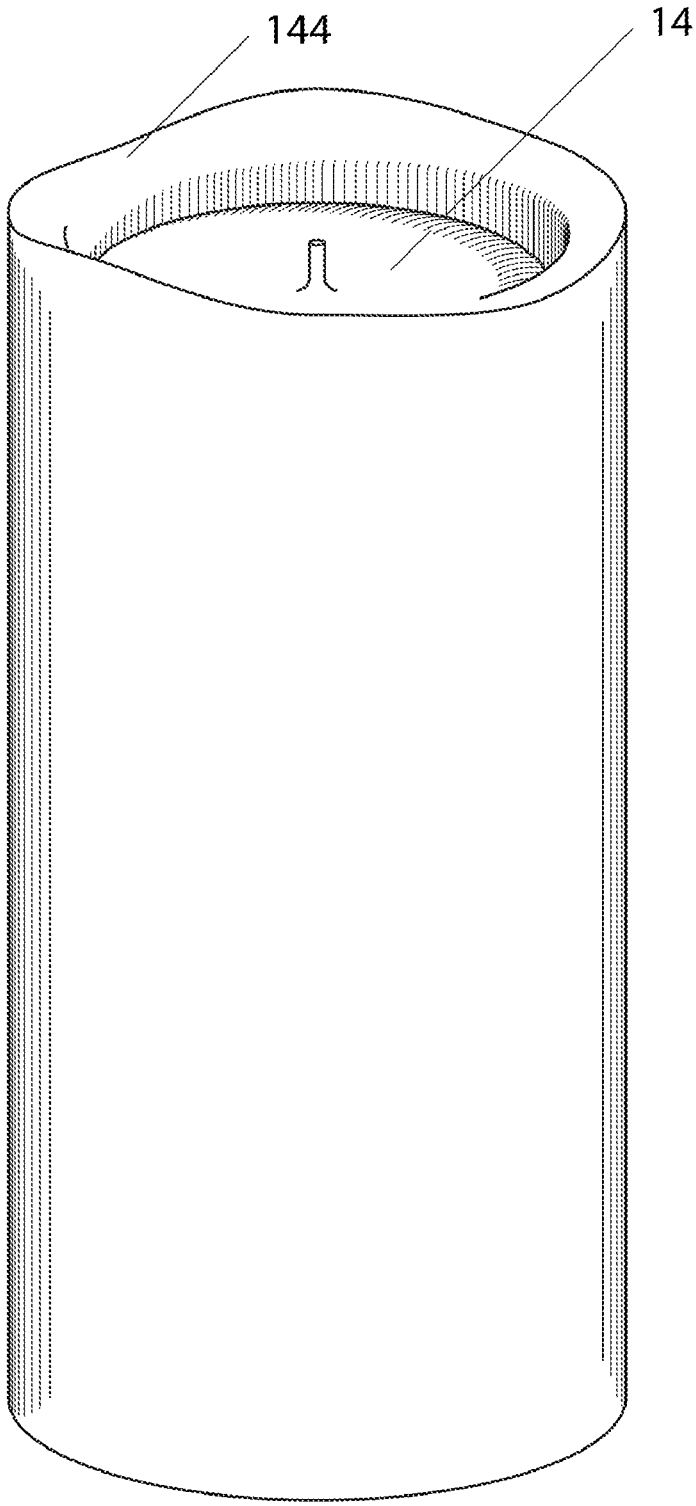
FIG. 1E shows a perspective view of a wavy top continuous fragrance and illumination device in accordance with another embodiment.
Figure 2A:
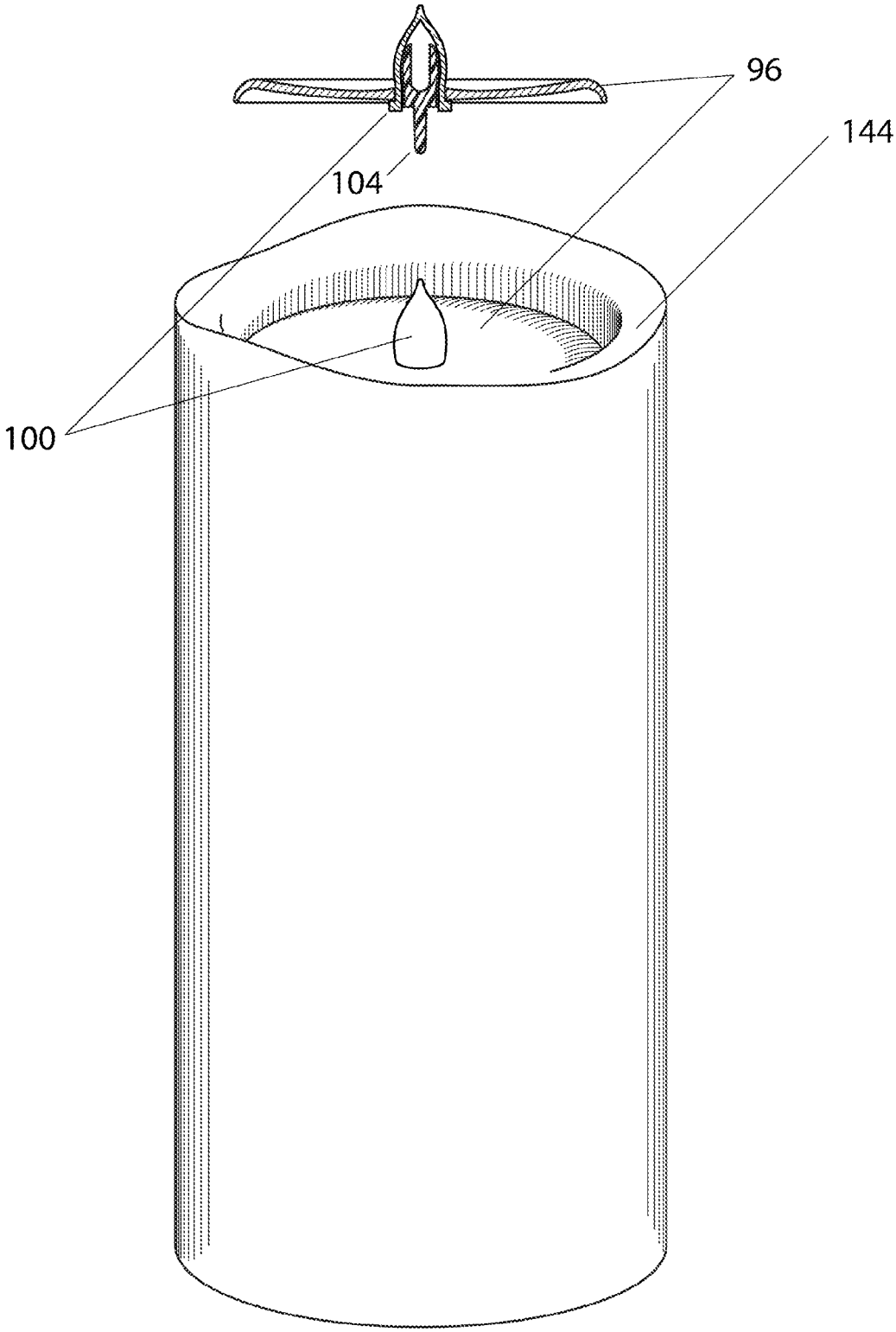
FIG. 2A shows a perspective view of a wavy top continuous fragrance and illumination device with a translucent flame top lid and a section elevation view of a translucent flame top lid in accordance with another embodiment.
Figure 6B:
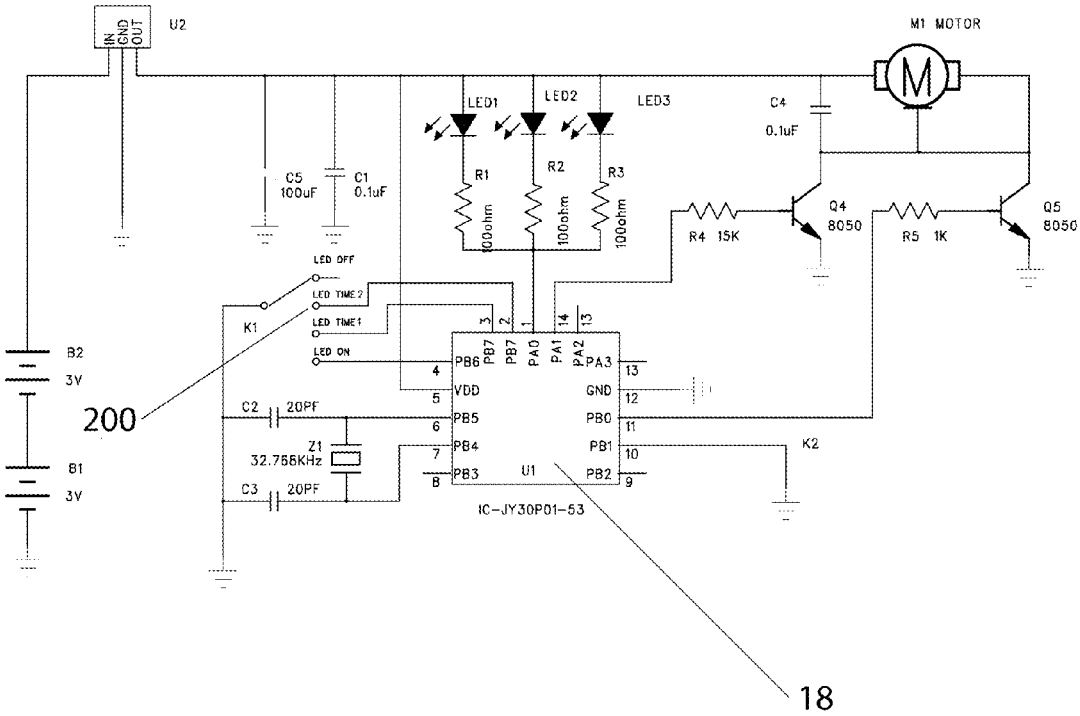
FIG. 6B shows a wiring diagram with a four-position switch for user selection of one of two periods of timed illumination.

FIGS. 1E, 2A, and 6B—Additional Embodiments

Additional exterior embodiments are shown in FIGS. 1E and 2A. In FIG. 1E the external appearance is modified to represent a wavy translucent shell 144 by providing a varying height to its top surface that simulates the appearance of a partially burned candle. In FIG. 2A a translucent flame top lid 96 is shown that mimics the appearance of a flickering flame when the light emitting diodes 84 are illuminated. This translucent flame top lid is constructed in the same manner as the translucent wick top lid 14, excepting that a hole approximately 8 mm in diameter is made at its center into which a flexible translucent flame top member 100 is inserted so its tip points upward. This flexible translucent flame top member comprising a circular flanged hollow cap pointed at one end to resemble a flame is secured into this hole by means of a support pin 104 constructed so its larger end expands when pushed inside the translucent flame top member. The translucent flame top member can be made of silicone or any other material that is sufficiently flexible to be inserted and secured in the manner described, and which provides sufficient translucency to diffuse light emitted by the light emitting diodes. The support pin can be made from any rigid clear material that can flex sufficiently to expand when pushed inside the translucent flame top member and secure it, and is sufficiently translucent so as not to impede the transmission of light and cause shadowing. It is desirable that all the materials used in the construction of the translucent flame top lid have the same refractive index as each other. In additional embodiments, multiple flame top members may be provided in one lid to mimic the appearance of candles that have several wicks. In these embodiments with multiple wicks the surface of the translucent flame top member 100 may be indented in a radial pattern surrounding the holes where the translucent flame top members are inserted. These radial indentations may overlap and thus give the appearance of merging melted pools of wax surrounding each translucent flame top member.

An additional embodiment is shown in FIG. 6B representing a wiring diagram where a second illumination timer 200 function is indicated that is selectable by the user to operate the candle intermittently for 4 hours on followed by 20 hours off; on a repeating 24 hour cycle. This is in addition to a timer function that is selectable for an on period of 8 hours, followed by an off period of 16 hours. Either timer function shown in FIG. 6B is made selectable by adding a fourth selectable position to control switch 64 shown in FIG. 1A.

Figure 4A:
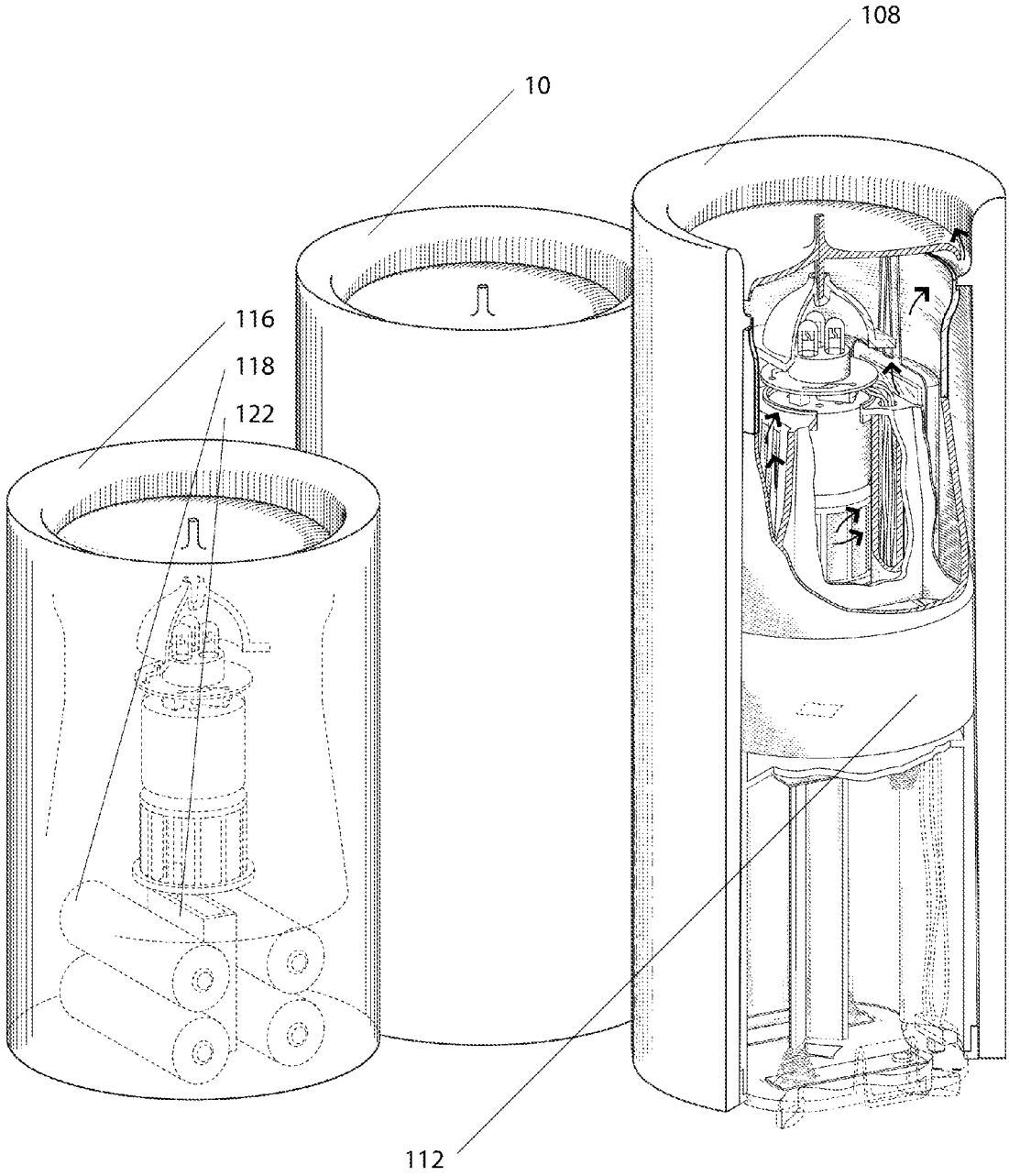
FIG. 4A shows a perspective view of a family of assorted height continuous fragrance and illumination devices in accordance with other embodiments.
Figure 5A:
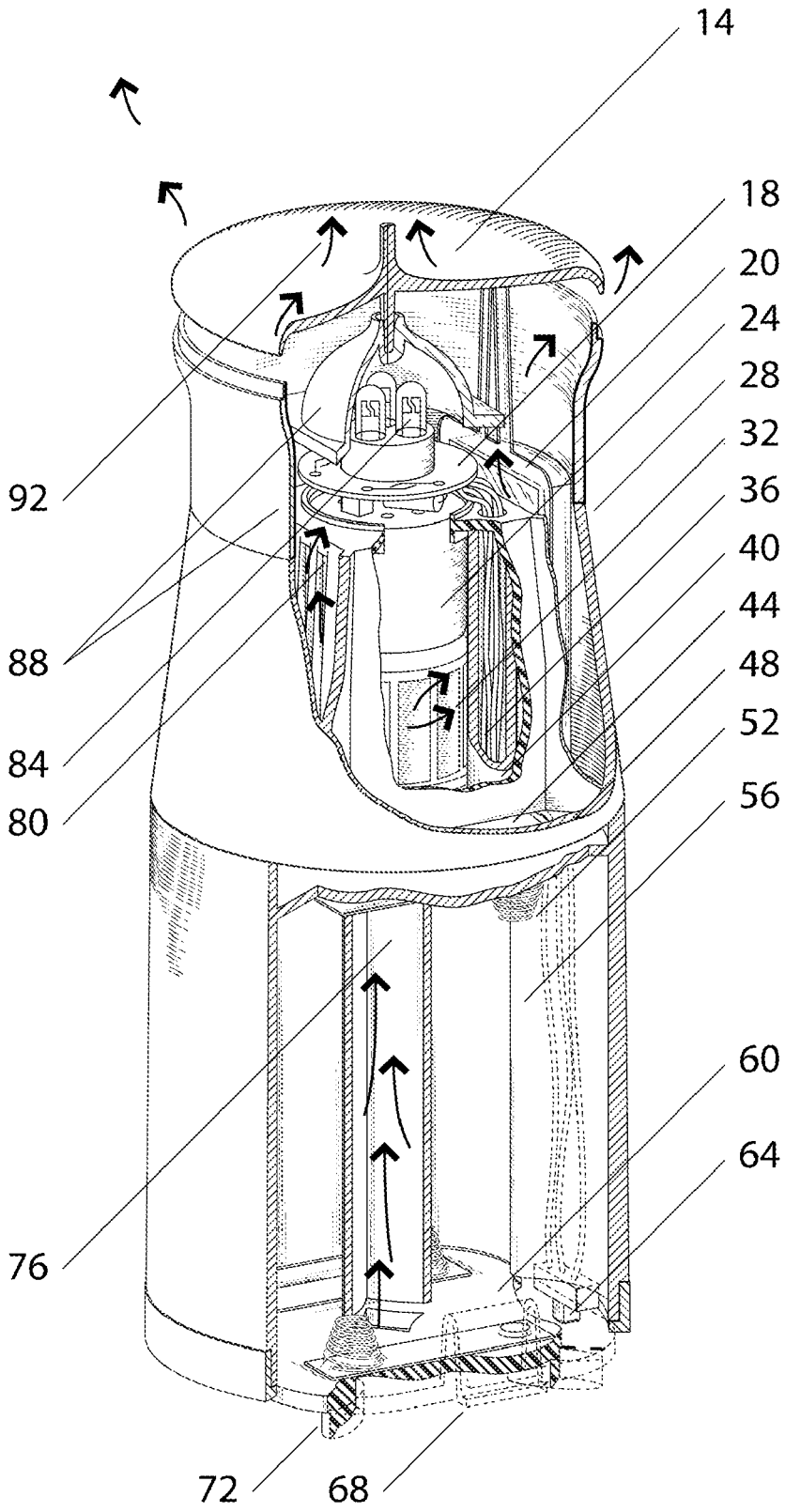
FIG. 5A shows a perspective cut-away view of a continuous fragrance and illumination device in accordance with another embodiment.
Figure 5B:
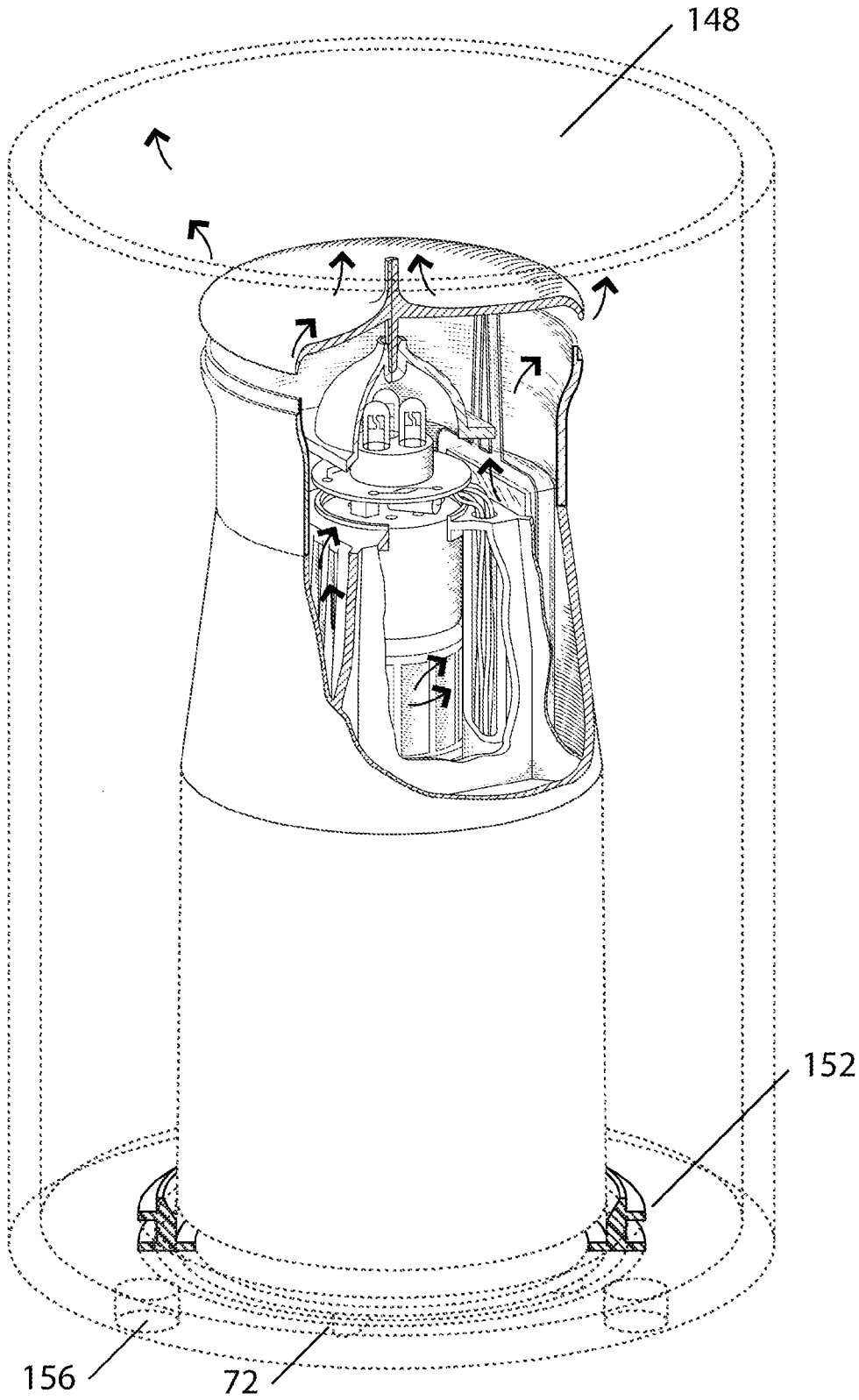
FIG. 5B shows a perspective cut-away view of a continuous fragrance and illumination device inserted into a container with a sealing ring in accordance with another embodiment.

FIGS. 4A, 5A and 5B—Alternate Embodiments

There are various possibilities that derive from the use of different height surrounds, and alternative surrounds, other than the flat translucent shell 10 and the wavy translucent shell 144 represented by FIGS. 1B and 1E, respectively. FIG. 4A shows a family of different height continuous fragrance and illumination devices made possible by varying the height of, or adding, certain components to the core structure. Whereas one embodiment shown in FIG. 4A of a flat translucent shell 10 is approximately 160 mm tall, both a shorter and a taller version may be provided. A shorter version of the continuous fragrance and illumination device that is approximately 130 mm tall is provided by reducing the height of the battery cell housing 56 shown in FIG. 1A and reconfiguring its internal layout to receive four AA size 1.5 volt batteries inserted in a horizontal configuration. The shape of the air intake flue 76 shown in FIG. 1A would also be changed in this embodiment such that its cross-section became rectangular but remained the same as the cross-section of the air intake flue shown in FIG. 1A. In this embodiment a shorter translucent shell would be provided, but this shell could be made by any of the techniques, or from any of the materials already described as suitable for the manufacture of translucent shells. A taller version of the continuous fragrance and illumination device that is approximately 190 mm tall is provided by securing a spacing member 112 that is approximately 30 mm tall between the top surface of the battery cell housing 56 and the lower surface of the air-moving member housing 48 shown in FIG. 1A. In this embodiment a taller translucent shell would be provided, but this shell could be made by any of the techniques, or from any of the materials already described as suitable for the manufacture of translucent shells.

In another alternative embodiment, FIG. 5A shows a continuous fragrance and illumination device provided without any exterior translucent shell. FIG. 5B shows a continuous fragrance and illumination device placed in an open-topped vessel 148. Vessels or containers of the type shown in FIG. 5B include metal, ceramic, resin and glass lanterns and hurricanes, but can include any translucent or pierced ornamental vessel or container suitable for displaying or housing a candle that may be placed indoors or under a covered outdoor area. Such vessels can also include seasonal surrounds such as pumpkins, angels and trees. These vessels may be perforated with filigree or pierced pattern work by those skilled in the art to better allow fragrance and illumination to diffuse from these perforations. To better facilitate air flow through the device a hole is provided in the bottom of the vessel and the edge of this hole is provided with a sealing ring 152 that is sized to fit the bottom cap of the continuous fragrance and illumination device. This sealing ring prevents any air from being drawn into the device from the bottom of the vessel that could include fragranced air leaving the top of the device. Protrusions 156 located on the underside of the vessel and of equal or greater height to the feet 72 shown in FIG. 1A allow air to feed into the bottom of the device.

Advantages

From the description above, a number of advantages of some embodiments of my continuous fragrance and illumination device become evident:

(a) The illumination chamber provides the effect of real wax candle illumination with the additional functionality of replaceable fragrance refills.

(b) Replacing used fragrance refills with new differently fragranced refills will produce a completely new fragrance from the same decoratively illuminating device.

(c) Fragrance refills are easily dropped in and lifted out without having to touch the exterior of the unit.

(d) One, or several, fragrance refills can be used to adjust the fragrance level depending on the room size.

(e) The vanishing edge lid design provides a brighter pool of light at the top of the device without any obvious vents to detract from the real candle appearance.

(f) The curved back of the fragrance refill provides an increase in the average depth of fragranced material as measured against the surface area that translates into a longer fragrancing life.

(g) With multiple slots within the fragrance refill chamber, several different fragrances can be mixed in recipes to personalize users' fragrance experiences.

(h) Regardless of the various dark colors that can sometimes result from combining gel and fragrance oil, there will be no effect on the illumination quality emanating from the candle because the refill trays are shielded from the illumination source.

Thus several advantages of one or more aspects are to provide a more functional and decorative illumination and fragrancing means. These and other advantages of one or more aspects will become apparent from a consideration of the ensuing description and accompanying drawings.

CONCLUSIONS, RAMIFICATIONS AND SCOPE

Accordingly, the reader will see that the fragrance and illumination devices of the various embodiments can be used to provide decorative illumination and continuous fragrance, and provide reusable vessels for replaceable fragrance refills. In addition, the various embodiments provide a comparable fragrance and illumination experience to that of real scented wax candles. Furthermore, the device has the additional advantages in that:

- it permits the production of fragrance and illumination devices in a variety of colors and decorative formats to meet the needs of consumers and retailers;
- it can provide replenishable fragrancing with the superior illumination of a real flame candle;
- it never needs to be replaced like a real candle that burns down and has to be discarded;
- it provides a way to customize and personalize fragrance that is easy to understand and use; and
- it can provide all the characteristics of a real scented candle without the worry of a real flame.

Although the description above contains many specificities, these should not be construed as limiting the scope of the embodiments but merely as providing illustrations of some of several embodiments. For example, the device can have other shapes such as square, trapezoidal, triangular, oval, etc. and it may be desirable for the outer shell to mimic such shapes; the fragrance refills can have other shapes such as novelty animal shapes, or other shapes, and can comprise more than one well to contain more than one fragranced gel, or more than one set of active chemical compounds. Furthermore, the device can be powered by induction or by mains power, etc., and the device can be incorporated into other decorative formats such as a candlescape set fixed to a plate, etc.

Thus the scope of the embodiments should be determined by any subsequent claims and their legal equivalents, rather than by the examples given.

We claim:

1. A device capable of receiving and volatizing a plurality of substances while artificially replicating the illumination and aesthetics of a lit solid fuel candle, comprising:

a. a translucent shell having an opening at one end through which volatized substances are capable of being expelled and designed to resemble in outward appearance a solid fuel candle, b. an air intake structure substantially surrounded by a battery cell housing capable of being enclosed at one end by a removable battery housing door and containing a plurality of openings designed to hold a predetermined number of battery cells such that when inserted into said battery cell housing and said battery housing door is closed, a predetermined voltage is supplied by means of battery cell contacts attached to said battery cell housing and said battery housing door, c. means for adhering said battery cell housing inside said translucent shell such that a tight and permanent hold ensues, d. a refill tray chamber with a plurality of internal openings facing to an air-moving member and having a uniformly tapered outer wall, a wider extremity of said tapered outer wall being an exact fit with an internal dimension of said translucent shell at a predetermined distance measured vertically from a lower edge of said translucent shell, e. means for connecting said refill tray chamber to said battery cell housing such that said wider extremity of said tapered outer wall of said refill chamber makes a continuous contact point with an inside surface of said translucent shell at said predetermined distance measured vertically from said lower edge of said translucent shell such that said continuous contact point forms an extremity of an illumination chamber with a surface defined by an exposed inner portion of said translucent shell intersecting said tapered outer wall of said refill tray chamber, f. a fan-moving member, g. means for mounting said fan-moving member centrally within said refill tray chamber and supplying a portion of said predetermined voltage to said fan-moving member such that said fan-moving member rotates in a predetermined direction, h. an air-moving member, i. means for mounting said air-moving member to said fan-moving member such that said air-moving member is exposed to air at an entrance of said refill tray chamber and said air-moving member rotates in said predetermined direction to cause said air to flow through said plurality of internal openings and through said refill tray chamber, j. a plurality of refill trays containing a volatile composition and sized substantially to slide into said plurality of internal openings of said refill tray chamber, k. a plurality of artificial light sources, l. means for configuring a circuit control board connected to said plurality of artificial light sources such that a current supplied to said plurality of artificial light sources is randomly varied with a resulting effect that said plurality of artificial light sources generate random patterns of illumination resembling a flickering flame of a solid fuel candle, m. means for mounting said plurality of artificial light sources and said circuit control board centrally within said refill tray chamber and supplying a portion of said predetermined voltage to said circuit control board, n. a translucent lens structure having an outer wall dimension substantially the same as a narrower end of said refill tray chamber, o. means for connecting said translucent lens structure to a narrower end of said refill tray chamber to enclose said artificial light sources in a such a way that an outer wall of said translucent lens structure joined to said tapered outer wall of said refill tray chamber defines an inner surface of an illumination chamber, p. a translucent wick top lid with having at its center a humanly graspable protrusion surrounded by a substantially horizontal surface terminating in vanishing-edge perimeter, q. means for attaching said translucent wick top lid in a humanly detachable way to a top of said translucent lens structure such that when said translucent wick top lid is attached to said top of said translucent lens structure a gap exists between said vanishing-edge perimeter of said translucent wick top lid and said opening of said translucent shell, and the surface area defined by said gap is greater that the cross-sectional area of said air intake structure substantially surrounded by said battery cell chamber, whereby random light patterns generated by said artificial light sources will be transmitted through said illumination chamber to said translucent shell in a manner that produces an even fall-off of illumination toward a tapered end of said illumination chamber, and said volatile compositions contained within said refill trays inserted into said refill tray chamber are volatized by air caused to flow through said refill tray chamber by said air-moving member and expelled through said gap between said translucent shell and said translucent wick top.

2. The device of claim 1 wherein said battery housing door has elevating feet on an exterior face.

3. The device of claim 1 wherein said translucent wick top lid has at its center a protrusion resembling a visual representation of an expected element of a solid fuel candle such as a wick or a flame.

4. The device of claim 1 wherein said translucent outer shell is made from wax-like material.

5. The device of claim 1 wherein said plurality of artificial light sources comprise light emitting diodes capable of emitting light with a wavelength between 580-600 nanometers.

* * * * *